US011009331B2

(12) United States Patent
Papillon et al.

(10) Patent No.: US 11,009,331 B2
(45) Date of Patent: May 18, 2021

(54) METHOD AND APPARATUS FOR WIRELESS BLASTING

(71) Applicant: Austin Star Detonator Company, Cleveland, OH (US)

(72) Inventors: Bryan E. Papillon, Phoenixville, PA (US); Larry S. Howe, Norwalk, OH (US); Thomas Allen Hoopes, Sandy, UT (US); Gimtong Teowee, Westlake Village, CA (US)

(73) Assignee: Austin Star Detonator Company, Cleveland, OH (US)

( * ) Notice: Subject to any disclaimer, the term of this patent is extended or adjusted under 35 U.S.C. 154(b) by 0 days.

(21) Appl. No.: 16/542,764

(22) Filed: Aug. 16, 2019

(65) Prior Publication Data

US 2020/0003535 A1 Jan. 2, 2020

Related U.S. Application Data

(62) Division of application No. 15/100,347, filed as application No. PCT/US2014/067880 on Dec. 1, 2014, now Pat. No. 10,429,162.

(Continued)

(51) Int. Cl.
*F42D 1/05* (2006.01)
*F42D 1/045* (2006.01)

(Continued)

(52) U.S. Cl.
CPC ..... *F42D 1/05* (2013.01); *F42D 1/045* (2013.01); *F42D 1/055* (2013.01); *F42D 5/00* (2013.01)

(58) Field of Classification Search
CPC ..... F42B 3/113; F42B 3/121; F42B 3/122; F42B 3/26; F42C 11/06; F42C 13/04;

(Continued)

(56) References Cited

U.S. PATENT DOCUMENTS 3,987,729 A 10/1976 Andrews et al.
4,005,631 A 2/1977 Kaiser et al.

(Continued)

FOREIGN PATENT DOCUMENTS

CN 201666766 U 12/2010
EP 0 897 098 A2 2/1999

(Continued)

OTHER PUBLICATIONS

US 8,266,754 B2, 09/2012, Ziegler et al. (withdrawn)
US 8,271,129 B2, 09/2012, Halloran et al. (withdrawn)
US 8,359,703 B2, 01/2013, Svendsen et al. (withdrawn)

*Primary Examiner* — Jared Fureman
*Assistant Examiner* — Nicolas Bellido
(74) *Attorney, Agent, or Firm* — Fay Sharpe LLP

(57) ABSTRACT

Systems, methods, blasting machines and wireless bridge units are presented for wireless blasting for safe firing of detonators under control of a remote wireless master controller in which the blasting machine is connected by cabling to the wireless bridge unit and power to a firing circuit of the blasting machine is remotely controlled via the bridge unit. The bridge unit selectively provides first and second firing messages to the blasting machine contingent upon acknowledgment of safe receipt of the first firing message by the blasting machine, and the blasting machine fires the connected detonators only if the first and second firing messages are correctly received from the bridge unit. A wireless slave blasting machine is disclosed, including a wireless transceiver for communicating with a remote wireless master controller, which fires the connected detonators only if first and second firing messages are wirelessly received from the master controller.

6 Claims, 10 Drawing Sheets

Related U.S. Application Data

(60) Provisional application No. 61/910,654, filed on Dec. 2, 2013.

(51) Int. Cl.
*F42D 1/055* (2006.01)
*F42D 5/00* (2006.01)

(58) Field of Classification Search
CPC ..... F42C 15/42; F42D 1/00; F42D 1/02; F42D 1/045; F42D 1/05; F42D 1/055; F42D 1/06; F42D 3/04; F42D 5/00; G01R 31/2829; G01V 1/104; G05B 2219/25054; G05B 2219/2665; G07C 2009/00317; G07C 2009/00325; G07C 2009/00333; G07C 2009/00341; G07C 2009/00349; G07C 2009/00357; G07C 2009/00365; G07C 2009/0038; G07C 2009/00555; G07C 2009/00579; G07C 2009/00587; G07C 2009/00595; G07C 2009/00603; G07C 9/00111; G07C 9/00182; G07C 9/00309; G07C 9/00571; H01H 39/00; H04L 25/0262; H04L 25/061
See application file for complete search history.

(56) References Cited

U.S. PATENT DOCUMENTS 4,037,538 A 7/1977 Andrews et al.
4,320,704 A 3/1982 Gawlick et al.
4,495,851 A 1/1985 Koerner et al.
4,576,093 A 3/1986 Snyder
4,777,880 A 10/1988 Beattie et al.
4,884,506 A 12/1989 Guerreri
5,038,682 A 8/1991 Marsden
5,069,131 A 12/1991 Kennedy et al.
5,159,149 A 10/1992 Marsden
5,214,236 A 5/1993 Murphy et al.
5,295,438 A 3/1994 Hill et al.
5,431,073 A 7/1995 Gregory
5,546,862 A 8/1996 Schabdach
5,769,034 A 6/1998 Zilka et al.
6,233,430 B1 5/2001 Helferich
6,253,061 B1 6/2001 Helferich
6,259,892 B1 7/2001 Helferich
6,321,690 B1 11/2001 Zilka et al.
6,422,145 B1 7/2002 Gavrilovic et al.
6,459,360 B1 10/2002 Helferich
6,462,646 B2 10/2002 Helferich
6,533,316 B2 3/2003 Breed et al.
6,557,636 B2 5/2003 Cernocky et al.
6,564,866 B2 5/2003 Clark et al.
6,565,119 B2 5/2003 Fogle, Jr.
6,584,907 B2 7/2003 Boucher et al.
6,604,468 B2 8/2003 Zilka et al.
6,618,237 B2 9/2003 Eddy et al.
6,644,201 B2 11/2003 Zilka et al.
6,648,097 B2 11/2003 Tite et al.
6,648,367 B2 11/2003 Breed et al.
6,696,291 B2 2/2004 Helferich
6,733,036 B2 5/2004 Breed et al.
6,755,156 B1 6/2004 Zilka et al.
6,837,310 B2 1/2005 Martin
6,860,206 B1 3/2005 Rudakevych et al.
6,889,610 B2 5/2005 Boucher et al.
6,905,135 B2 6/2005 Breed
6,928,030 B2 8/2005 Chamberlain et al.
6,938,689 B2 9/2005 Farrant et al.
6,941,870 B2 9/2005 McClure et al.
6,955,217 B2 10/2005 Clark et al.
6,962,202 B2 11/2005 Hell et al.
6,988,449 B2 1/2006 Teowee et al.
7,003,304 B1 2/2006 Helferich
7,039,428 B1 5/2006 Helferich
7,103,510 B2 9/2006 Moolman et al.
7,143,696 B2 12/2006 Rudakevych et al.
7,155,241 B2 12/2006 Helferich
7,232,001 B2 6/2007 Hakki et al.
7,242,951 B2 7/2007 Helferich
7,273,102 B2 9/2007 Sheffield
7,277,715 B2 10/2007 Starr et al.
7,278,658 B2 10/2007 Boucher et al.
7,280,838 B2 10/2007 Helferich
7,284,489 B2 10/2007 Bell et al.
7,284,601 B2 10/2007 Bell et al.
7,322,416 B2 1/2008 Burris, II et al.
7,327,550 B2 2/2008 Meyer et al.
7,347,144 B2 3/2008 Teowee et al.
7,347,145 B2 3/2008 Teowee et al.
7,347,278 B2 3/2008 Lerche et al.
7,350,448 B2 4/2008 Bell et al.
7,363,967 B2 4/2008 Burris, II et al.
7,370,513 B2 5/2008 Meyer et al.
7,370,583 B2 5/2008 Hallin et al.
7,376,432 B2 5/2008 Helferich
7,383,882 B2 6/2008 Lerche et al.
7,395,760 B2 7/2008 Zilka et al.
7,403,787 B2 7/2008 Helferich
7,436,937 B2 10/2008 Clawson
7,437,985 B2 10/2008 Gal
7,451,700 B1 11/2008 Land
7,461,580 B2 12/2008 Bell et al.
7,464,647 B2 12/2008 Teowee et al.
7,478,680 B2 1/2009 Sridharan et al.
7,479,624 B2 1/2009 Morris
7,481,453 B2 1/2009 Breed
7,493,859 B2 2/2009 Russell
7,499,716 B2 3/2009 Helferich
7,520,323 B2 4/2009 Lerche et al.
7,568,429 B2 8/2009 Hummel et al.
7,577,756 B2 8/2009 Teowee et al.
7,581,413 B2 9/2009 Block et al.
7,594,471 B2 9/2009 Koekemoer et al.
7,597,047 B2 10/2009 Doyle et al.
7,617,775 B2 11/2009 Teowee
7,648,164 B2 1/2010 Breed
7,650,841 B2 1/2010 McClure et al.
7,661,348 B2 2/2010 Murello
7,676,973 B1 3/2010 Powers
7,681,500 B2 3/2010 Teowee
7,710,820 B2 5/2010 Clark
7,712,405 B2 5/2010 Toycen et al.
7,740,273 B2 6/2010 Breed
7,744,122 B2 6/2010 Breed
7,762,580 B2 7/2010 Breed
7,774,115 B2 8/2010 Breed
7,778,006 B2 8/2010 Stewart et al.
7,784,389 B2 8/2010 Mardirossian
7,791,858 B2 9/2010 Hummel et al.
7,802,509 B2 9/2010 Wall
7,810,421 B2 10/2010 Hiza et al.
7,810,430 B2 10/2010 Chan et al.
7,814,833 B1 10/2010 Land
7,814,970 B2 10/2010 Strickland
7,823,508 B2 11/2010 Anderson et al.
7,832,762 B2 11/2010 Breed
7,835,757 B2 11/2010 Helferich
7,843,314 B2 11/2010 Helferich
7,848,078 B2 12/2010 Hummel et al.
7,861,924 B1 1/2011 Block et al.
7,866,544 B1 1/2011 Block et al.
7,874,250 B2 1/2011 Veneruso
7,882,921 B2 2/2011 Hakki et al.
7,882,926 B2 2/2011 Fullerton
7,883,008 B1 2/2011 Miller et al.
7,886,866 B2 2/2011 Fullerton
7,911,760 B2 3/2011 Lownds
7,922,491 B2 4/2011 Jones et al.
7,929,270 B2 4/2011 Hummel et al.
7,930,923 B2 4/2011 Patel et al.
7,934,453 B2 5/2011 Moore
7,946,209 B2 5/2011 Schneider et al.

(56) References Cited

U.S. PATENT DOCUMENTS 7,946,480 B2 5/2011 Miller et al.
7,954,703 B2 6/2011 Miller et al.
7,958,824 B2 6/2011 Stewart
7,975,592 B2 7/2011 Bell et al.
7,975,612 B2 7/2011 Teowee et al.
7,975,613 B2 7/2011 Labuschagne et al.
7,975,774 B2 7/2011 Akcasu
7,989,742 B2 8/2011 Bredy
7,990,286 B2 8/2011 Shankwitz et al.
7,992,777 B1 8/2011 Block et al.
8,011,928 B1 9/2011 Schaeffer et al.
8,020,491 B2 9/2011 Simon
8,022,839 B2 9/2011 Goodman
8,035,255 B2 10/2011 Kurs et al.
8,069,789 B2 12/2011 Hummel et al.
8,084,725 B1 12/2011 Dryer
8,087,956 B2 1/2012 Nakayama
8,106,539 B2 1/2012 Schatz et al.
8,107,601 B2 1/2012 Helferich
8,109,191 B1 2/2012 Rudakevych et al.
8,116,741 B2 2/2012 Helferich
8,122,830 B2 2/2012 Moore
8,127,983 B1 3/2012 Block et al.
8,134,450 B2 3/2012 Helferich
8,134,822 B2 3/2012 Ballantine et al.
8,136,624 B2 3/2012 Fullerton
8,151,882 B2 4/2012 Grigar et al.
8,152,055 B2 4/2012 Miller et al.
8,172,034 B2 5/2012 Fullerton
8,186,578 B1 5/2012 Block et al.
8,220,706 B1 7/2012 Miller et al.
8,224,294 B2 7/2012 Helferich
8,250,961 B2 8/2012 Mardirossian
8,261,976 B1 9/2012 Block et al.
8,292,022 B2 10/2012 Fullerton
8,295,450 B2 10/2012 Helferich et al.
8,302,730 B2 11/2012 Fullerton
8,304,935 B2 11/2012 Karalis et al.
8,324,759 B2 12/2012 Karalis
8,336,766 B1 12/2012 Miller et al.
8,346,438 B2 1/2013 Breed
8,347,092 B2 1/2013 Wilson et al.
8,348,151 B1 1/2013 Block et al.
8,353,450 B2 1/2013 Miller et al.
8,355,702 B2 1/2013 Helferich
8,368,339 B2 2/2013 Jones et al.
8,369,062 B2 2/2013 Fisher et al.
8,374,585 B2 2/2013 Helferich
8,374,721 B2 2/2013 Halloran et al.
8,375,838 B2 2/2013 Rudakevych et al.
8,380,350 B2 2/2013 Ozick et al.
8,385,042 B2 2/2013 McCann et al.
8,387,193 B2 3/2013 Ziegler et al.
8,390,251 B2 3/2013 Cohen et al.
8,395,878 B2 3/2013 Stewart et al.
8,400,017 B2 3/2013 Kurs et al.
8,410,636 B2 4/2013 Kurs et al.
8,421,587 B2 4/2013 Link
8,438,695 B2 5/2013 Gilbert, Jr. et al.
8,441,154 B2 5/2013 Karalis et al.
8,441,370 B2 5/2013 Bonavides et al.
8,451,137 B2 5/2013 Bonavides et al.
8,459,546 B1 6/2013 Block et al.
8,461,719 B2 6/2013 Kesler et al.
8,461,720 B2 6/2013 Kurs et al.
8,461,721 B2 6/2013 Karalis et al.
8,461,722 B2 6/2013 Kurs et al.
8,461,803 B2 6/2013 Cohen et al.
8,466,583 B2 6/2013 Karalis et al.
8,468,244 B2 6/2013 Redlich et al.
8,468,914 B2 6/2013 Givens et al.
8,468,944 B2 6/2013 Givens et al.
8,471,410 B2 6/2013 Karalis et al.
8,474,379 B2 7/2013 Jacobson et al.
8,476,788 B2 7/2013 Karalis et al.
8,479,983 B1 7/2013 Block et al.
8,480,397 B2 7/2013 Gerber et al.
8,482,158 B2 7/2013 Kurs et al.
8,487,480 B1 7/2013 Kesler et al.
8,487,755 B2 7/2013 Gudgel et al.
8,496,168 B1 7/2013 Miller et al.
8,497,601 B2 7/2013 Hall et al.
8,497,987 B2 7/2013 Miller et al.
8,498,387 B2 7/2013 Helferich
8,516,963 B2 8/2013 Bossarte et al.
8,528,157 B2 9/2013 Schnittman et al.
8,552,592 B2 10/2013 Schatz et al.
8,805,814 B2 8/2014 Zijlstra et al.
9,450,684 B2 9/2016 Roper et al.
10,267,611 B2 * 4/2019 Lownds ..... F42D 5/00
2001/0007247 A1 7/2001 Zilka et al.
2001/0015548 A1 8/2001 Breed et al.
2001/0020892 A1 9/2001 Helferich
2001/0048215 A1 12/2001 Breed et al.
2002/0027346 A1 3/2002 Breed et al.
2002/0101067 A1 8/2002 Breed
2002/0112638 A1 8/2002 Zilka et al.
2002/0178955 A1 12/2002 Gavrilovic et al.
2003/0010565 A1 1/2003 Brooks et al.
2003/0052769 A1 3/2003 Helferich
2003/0135327 A1 7/2003 Levine et al.
2004/0107858 A1 6/2004 Zilka et al.
2004/0206503 A1 10/2004 Bell et al.
2004/0216698 A1 11/2004 Zilka et al.
2005/0000382 A1 1/2005 Hummel et al.
2005/0015473 A1 1/2005 Teowee et al.
2005/0030695 A1 2/2005 Meyer et al.
2005/0131655 A1 6/2005 Moolman et al.
2005/0134432 A1 6/2005 Helferich
2005/0164652 A1 7/2005 Helferich
2005/0164653 A1 7/2005 Helferich
2005/0164654 A1 7/2005 Helferich
2005/0170792 A1 8/2005 Helferich
2005/0215272 A1 9/2005 Helferich
2005/0243499 A1 11/2005 Hallin et al.
2005/0247109 A1 11/2005 Meyer et al.
2006/0027121 A1 2/2006 Kockemoer et al.
2006/0027191 A1 2/2006 Zilka et al.
2006/0130693 A1 6/2006 Teowee
2006/0183465 A1 8/2006 Helferich
2006/0219122 A1 10/2006 Teowee et al.
2006/0232052 A1 10/2006 Breed
2006/0262480 A1 11/2006 Stewart
2006/0268246 A1 11/2006 Jacobs et al.
2007/0044673 A1 3/2007 Hummel et al.
2007/0116189 A1 5/2007 Clawson
2007/0155437 A1 7/2007 Helferich
2007/0159766 A1 7/2007 Lownds
2007/0207669 A1 9/2007 Hummel et al.
2007/0228703 A1 10/2007 Breed
2007/0228793 A1 10/2007 Breed
2007/0272110 A1 11/2007 Brent et al.
2008/0041261 A1 2/2008 Hummel et al.
2008/0067792 A1 3/2008 Breed
2008/0082237 A1 4/2008 Breed
2008/0098921 A1 5/2008 Labuschagne et al.
2008/0125940 A1 5/2008 Breed
2008/0156217 A1 7/2008 Stewart et al.
2008/0173204 A1 7/2008 Anderson et al.
2008/0236377 A1 10/2008 Wall
2008/0243342 A1 10/2008 Breed
2008/0272580 A1 11/2008 Breed
2008/0277911 A1 11/2008 Breed
2008/0282925 A1 11/2008 Lownds et al.
2008/0284145 A1 11/2008 Breed
2008/0284156 A1 11/2008 Breed
2008/0293385 A1 11/2008 Helferich
2008/0302264 A1 12/2008 Hummel et al.
2009/0019957 A1 1/2009 Eisenman et al.
2009/0163190 A1 6/2009 Helferich
2009/0188379 A1 7/2009 Hiza et al.
2009/0191848 A1 7/2009 Helferich
2009/0254572 A1 10/2009 Redlich et al.
2009/0283005 A1 11/2009 Teowee

(56) References Cited

U.S. PATENT DOCUMENTS

2009/0283994 A1 11/2009 Teowee et al.
2010/0005994 A1 1/2010 Jacobson et al.
2010/0041331 A1 2/2010 Helferich
2010/0066851 A1 3/2010 Pooley et al.
2010/0107917 A1 5/2010 Moser
2010/0109445 A1 5/2010 Kurs et al.
2010/0141042 A1 7/2010 Kesler et al.
2010/0164297 A1 7/2010 Kurs et al.
2010/0164298 A1 7/2010 Karalis et al.
2010/0171368 A1 7/2010 Schatz et al.
2010/0180788 A1 7/2010 Hummel et al.
2010/0181843 A1 7/2010 Schatz et al.
2010/0181845 A1 7/2010 Fiorello et al.
2010/0201203 A1 8/2010 Schatz et al.
2010/0203872 A1 8/2010 Helferich
2010/0212527 A1 8/2010 McCann et al.
2010/0219694 A1 9/2010 Kurs et al.
2010/0231340 A1 9/2010 Fiorello et al.
2010/0237709 A1 9/2010 Hall et al.
2010/0250497 A1 9/2010 Redlich et al.
2010/0259108 A1 10/2010 Giler et al.
2010/0259110 A1 10/2010 Kurs et al.
2010/0264747 A1 10/2010 Hall et al.
2010/0275799 A1 11/2010 Hummel et al.
2010/0277121 A1 11/2010 Hall et al.
2010/0286800 A1 11/2010 Lerche et al.
2010/0308939 A1 12/2010 Kurs
2010/0328838 A1 12/2010 Lownds
2011/0043047 A1 2/2011 Karalis et al.
2011/0043048 A1 2/2011 Karalis et al.
2011/0043049 A1 2/2011 Karalis et al.
2011/0072956 A1 3/2011 Wall
2011/0090091 A1 4/2011 Lerche et al.
2011/0095618 A1 4/2011 Schatz et al.
2011/0000244 A1 5/2011 Labuschagne et al.
2011/0174181 A1 7/2011 Plummer et al.
2011/0217955 A1 9/2011 Helferich
2011/0230270 A1 9/2011 Helferich
2011/0244802 A1 10/2011 Kozlowski et al.
2011/0247517 A1* 10/2011 Hurley ..... F42D 1/055 102/215
2011/0265677 A1 11/2011 Hummel et al.
2011/0302615 A1 12/2011 Helferich
2012/0042800 A1 2/2012 McCann et al.
2012/0086284 A1 4/2012 Capanella et al.
2012/0086867 A1 4/2012 Kesler et al.
2012/0091794 A1 4/2012 Campalella et al.
2012/0091795 A1 4/2012 Fiorello et al.
2012/0091796 A1 4/2012 Kesler et al.
2012/0091797 A1 4/2012 Kesler et al.
2012/0091819 A1 4/2012 Kulikowski et al.
2012/0091820 A1 4/2012 Campanella et al.
2012/0091949 A1 4/2012 Campanella et al.
2012/0091950 A1 4/2012 Campanella et al.
2012/0112531 A1 5/2012 Kesler et al.
2012/0112532 A1 5/2012 Kesler et al.
2012/0112534 A1 5/2012 Kesler et al.
2012/0112535 A1 5/2012 Karalis et al.
2012/0112536 A1 5/2012 Karalis et al.
2012/0112538 A1 5/2012 Kesler et al.
2012/0112691 A1 5/2012 Kum et al.
2012/0119569 A1 5/2012 Karalis et al.
2012/0119576 A1 5/2012 Kesler et al.
2012/0119675 A1 5/2012 Kurs et al.
2012/0119698 A1 5/2012 Karalis et al.
2012/0153732 A1 6/2012 Kurs et al.
2012/0153733 A1 6/2012 Schatz et al.
2012/0153734 A1 6/2012 Kurs et al.
2012/0153735 A1 6/2012 Karalis et al.
2012/0153736 A1 6/2012 Karalis et al.
2012/0153737 A1 6/2012 Karalis et al.
2012/0153738 A1 6/2012 Karalis et al.
2012/0153893 A1 6/2012 Schatz et al.
2012/0174809 A1 7/2012 Stewart et al.
2012/0184338 A1 7/2012 Kesler et al.
2012/0223573 A1 9/2012 Schatz et al.
2012/0227608 A1 9/2012 Givens et al.
2012/0228952 A1 9/2012 Hall et al.
2012/0228953 A1 9/2012 Kesler et al.
2012/0228954 A1 9/2012 Kesler et al.
2012/0235501 A1 9/2012 Kesler et al.
2012/0235502 A1 9/2012 Kesler et al.
2012/0235503 A1 9/2012 Kesler et al.
2012/0235504 A1 9/2012 Kesler et al.
2012/0235505 A1 9/2012 Schatz et al.
2012/0235567 A1 9/2012 Karalis et al.
2012/0235568 A1 9/2012 Prodin et al.
2012/0235633 A1 9/2012 Kesler et al.
2012/0239117 A1 9/2012 Kesler et al.
2012/0242135 A1 9/2012 Thomson et al.
2012/0242159 A1 9/2012 Lou et al.
2012/0242225 A1 9/2012 Karalis et al.
2012/0248886 A1 10/2012 Kesler et al.
2012/0248887 A1 10/2012 Kesler et al.
2012/0248888 A1 10/2012 Kesler et al.
2012/0248981 A1 10/2012 Karalis et al.
2012/0256494 A1 10/2012 Kesler et al.
2012/0274147 A1 11/2012 Stecher et al.
2012/0280765 A1 11/2012 Kurs et al.
2012/0299708 A1 11/2012 Guyon et al.
2012/0313449 A1 12/2012 Kurs et al.
2012/0313742 A1 12/2012 Kurs et al.
2013/0057364 A1 3/2013 Kesler et al.
2013/0063299 A1 3/2013 Proudkii
2013/0098257 A1 4/2013 Goodridge et al.
2013/0125772 A1 5/2013 Backhus et al.
2013/0154389 A1 6/2013 Kurs et al.
2013/0157625 A1 6/2013 Helferich
2013/0175875 A1 7/2013 Kurs et al.
2013/0200716 A1 8/2013 Kesler et al.
2013/0206236 A1 8/2013 Hosseini et al.
2014/0026775 A1 1/2014 Papillon
2014/0084859 A1 3/2014 Hall et al.
2021/0003377 A1* 1/2021 Monroe ..... F42D 1/05

FOREIGN PATENT DOCUMENTS

EP 0 974 035 B1 2/2002
EP 1 027 574 B1 1/2003
EP 1 067 349 B1 1/2004
EP 1 216 391 B1 3/2004
EP 1 426 719 6/2004
EP 1 432 959 B1 6/2004
EP 1 452 813 A3 9/2004
EP 1 021 868 B1 12/2005
EP 1 692 822 B1 5/2007
EP 1 782 019 B1 11/2008
EP 2 357 442 A2 8/2011
EP 1 848 960 B1 12/2011
EP 2 082 184 B1 6/2012
EP 2 069 710 B1 12/2012
EP 1 859 223 B1 3/2013
EP 1 687 584 B1 4/2013
WO WO 01/59401 A1 8/2001
WO WO 01/67031 A1 9/2001
WO WO 02/099356 A2 12/2002
WO WO 03/029748 A1 4/2003
WO WO 03/076868 A1 9/2003
WO WO 03/083406 A1 10/2003
WO WO 2005/006689 A1 1/2005
WO WO 2005/052498 A1 6/2005
WO WO 2005/052499 A1 6/2005
WO WO 2005/060173 A1 6/2005
WO WO 2005/090595 A2 9/2005
WO WO 2005/090895 A1 9/2005
WO WO 2006/047823 A1 5/2006
WO WO 2006/076777 A1 7/2006
WO WO 2006/076778 A1 7/2006
WO WO 2007/085916 A1 8/2007
WO WO 2007/088404 A1 8/2007
WO WO 2007/124538 A1 11/2007
WO WO 2008/022399 A1 2/2008
WO WO 2008/078288 A1 7/2008
WO WO 2008/098302 A1 8/2008

(56) References Cited

FOREIGN PATENT DOCUMENTS

| | | | |
|---|---|---|---|
| WO | WO 2008/138070 | A1 | 11/2008 |
| WO | WO 2009/143585 | A1 | 12/2009 |
| WO | WO 2010/034442 | A1 | 4/2010 |
| WO | WO 2010/036980 | A1 | 4/2010 |
| WO | WO 2010/048587 | A1 | 4/2010 |
| WO | WO 2010/085837 | A1 | 8/2010 |
| WO | WO 2010/093997 | A1 | 8/2010 |
| WO | WO 2010/101597 | A2 | 9/2010 |
| WO | WO 2011/038449 | A1 | 4/2011 |
| WO | WO 2011/130099 | A2 | 10/2011 |
| WO | WO 2011/140549 | A2 | 11/2011 |
| WO | WO 2011/143679 | A1 | 11/2011 |
| WO | WO 2012/029877 | A1 | 3/2012 |
| WO | WO 2012/061850 | A1 | 5/2012 |
| WO | WO 2012/077082 | A1 | 6/2012 |
| WO | WO 2012/148450 | A1 | 11/2012 |
| WO | WO 2012/149277 | A2 | 11/2012 |
| WO | WO 2012/149584 | A1 | 11/2012 |
| WO | WO 2013/093300 | | 6/2013 |
| WO | WO 2013 116938 | A1 | 8/2013 |

* cited by examiner

METHOD AND APPARATUS FOR WIRELESS BLASTING

REFERENCE TO RELATED APPLICATION

This application is a divisional of currently pending U.S. patent application Ser. No. 15/100,347, filed on May 31, 2016 which claims priority to, and the benefit of, U.S. Provisional Patent Application No. 61/910,654, filed on Dec. 2, 2013, entitled METHOD AND APPARATUS FOR WIRELESS BLASTING, which applications are hereby incorporated by reference.

TECHNICAL FIELD

The present disclosure relates generally to the field of blasting technology, and particularly involves methods and apparatus for wireless remote blasting.

BACKGROUND

In blasting operations, detonators and explosives are buried in the ground, for example, in holes (e.g., bore holes) drilled into rock formations, etc., and the detonators are wired for external access to blasting machines that provide electrical firing signaling to initiate detonation of explosives. Wireless blasting involves use of a remotely located master controller and a local slave wireless device connected to a blasting machine at the blast site, with the blasting machine being wired to an array of detonators. In wireless blasting systems, no wiring or lead lines are connected between the detonator array and the master controller, and the master controller can be positioned a significant distance from the blast site, such as 1-5 miles in one example. The blasting machine is normally turned on together with the slave controller as the operator walks from the blast area to the master controller site some distance away, where the blast sequence includes power up, verification and/or programming of delay times, arming and finally issuance of a "fire" command. The blasting machine provides sufficient energy and voltage to charge the firing capacitors in the detonators, and initiates the actual detonator firing in response to the fire command. During the firing phase, upon operator input at the master controller, a fire command is transferred from the master to the slave which then issues the final command to the blasting machine in order to fire the detonator array. Accordingly, improved techniques, systems and apparatus are desirable for improved safety in wireless remote blasting.

SUMMARY

Various aspects of the present disclosure are now summarized to facilitate a basic understanding of the disclosure, wherein this summary is not an extensive overview of the disclosure, and is intended neither to identify certain elements of the disclosure, nor to delineate the scope thereof. Instead, the primary purpose of this summary is to present some concepts of the disclosure in a simplified form prior to the more detailed description that is presented hereinafter.

The disclosure relates to systems, methods and apparatus for electronic blasting, and provides improved blasting machine and slave bridge unit operation to facilitate improved safety and controllability compared with conventional wireless blasting. The disclosed apparatus provides remote blasting machine turn on and/or turnoff as well as reliable fire command issuance procedures using multiple fire command messages to facilitate improved safety and immunity from spurious noise. In certain implementations, the firing circuitry of the blasting machine is not powered up even though the branch lines or a lead line may be connected with the array of detonators, with the local slave bridge unit controlling the firing circuit power condition to apply power only if the bridge unit/master control unit wireless link is established. The fire command initiation process provides two or more fire commands issued by the slave bridge unit and properly received by the blasting machine in order to actually fire the control detonators. These devices and techniques thus advantageously facilitate safe blasting using remote wireless master control.

One or more aspects of the present disclosure relate to methods for wireless detonator blasting, including wirelessly receiving a wireless fire command message from a master controller at a wireless enabled bridge unit coupled with a blasting machine, and sending a first command message from the bridge unit to the blasting machine. The methods further include selectively sending a second fire command message from the bridge unit to the blasting machine in response to receipt of a fire command acknowledgment message from the blasting machine or after a predetermined period of time has elapsed since the first fire command message was sent. In certain embodiments, the second fire command message is sent to the blasting machine only if the fire command acknowledgment message is received within a predetermined time after the first fire command message was sent. In this manner, the method advantageously mitigates or avoids the possibility of a blasting machine inadvertently firing detonators based on receipt of noise or other spurious signaling, thereby facilitating safe, predictable remote wireless blasting. In addition, certain embodiments facilitate safe controlled operation during detonator verification and/or arming using multiple messages from the bridge unit and corresponding acknowledgment from the blasting machine. In various embodiments, moreover, the bridge unit is used to selectively enable or disable the firing circuit of the blasting machine. This, in turn, facilitates manual connection of the blasting machine to the detonator array and connection of the slave bridge unit while ensuring that the firing circuit of the blasting machine is unpowered. Moreover, the ability to thereafter turn off power to the blasting machine firing circuit via the RF-enabled bridge unit advantageously allows blasting personnel to visit the blasting site for troubleshooting while ensuring that the blasting machine is incapable of firing any detonators.

Further aspects of the disclosure provide a bridge unit for remote wireless operation of a blasting machine. The bridge unit includes a communications interface for connection to a blasting machine, as well as a wireless transceiver for interfacing with a master control unit, and at least one processor. The processor is programmed to receive a wireless fire command message from the master controller, to send a first fire command message to the blasting machine, and to selectively send a second fire command message to the blasting machine responsive to receipt of a fire command acknowledgment message from the blasting machine. In certain implementations, the bridge unit sends the second fire command message only if the acknowledgment of the first message is received from the blasting machine within a predetermined time. The bridge unit may be configured in certain embodiments to issue multiple command messages to the blasting machine for verification and/or arming operations, with the second or subsequent messages being sent only if proper acknowledgment is received from the blasting machine to ensure that these commands are initiated only when needed. Moreover, certain embodiments of the bridge unit involve the processor being programmed to selectively enable or disable the blasting machine firing circuit.

Still other aspects of the present disclosure involve a blasting machine with a communications interface for communicating with a connected bridge unit, as well as a firing circuit and at least one processor programmed to receive and acknowledge a first fire command from the bridge unit, and to selectively fire one or more connected detonators in response to receiving a second fire command message. In certain implementations, the detonators are fired only if the second fire command message is received from the bridge unit within a predetermined time period. The blasting machine processor in certain embodiments is programmed to verify the fire command messages and issue acknowledgment of the first message only if verified as correct and/or fire the detonators only if the second fire command is verified as correct. In certain embodiments, moreover, the blasting machine firing circuit can be selectively enabled or disabled by a connected bridge unit.

Further aspects of the disclosure provide an integrated wireless slave blasting machine having a wireless communications interface for communicating with a wireless master controller, as well as at least one processor and a firing circuit. The wireless slave blasting machine processor is programmed to fire connected detonators only if first and second firing messages are wirelessly received from the master controller. In addition, the wireless blasting machine is operative in certain embodiments to send a fire command acknowledgment message to the master controller via the wireless transceiver in response to receiving the first fire command message, and/or to selectively enable or disable the firing circuit in response to wirelessly receiving a remote turn on or remote turn off command from the master controller.

In accordance with further aspects of the disclosure, blasting machines, remote master controllers and methods are provided for preventing remote out of sync conditions in a wireless detonator blasting operation, in which the blasting machine sends the master controller a data packet with a data designation number and refrains from processing a received message command until the master controller sends back the data designation number.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
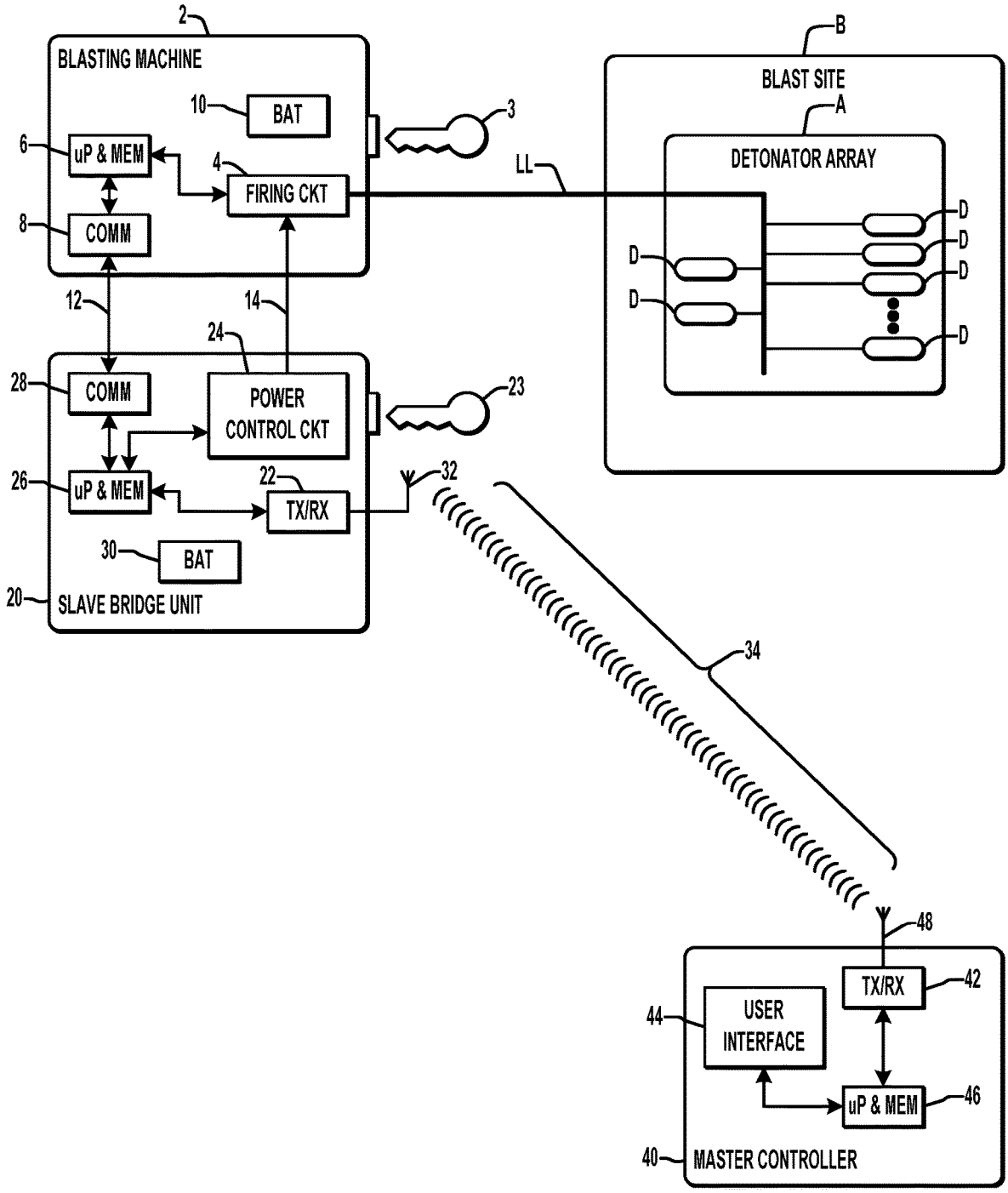
FIG. 1 is a simplified system diagram illustrating a wireless blasting system for remotely firing an array of detonators connected to a blasting machine at a blast site, including a remotely located wireless master controller and a wireless slave bridge unit connected to the blasting machine in accordance with one or more aspects of the present disclosure.

Referring now to the figures, several embodiments or implementations of the present disclosure are hereinafter described in conjunction with the drawings, wherein like reference numerals are used to refer to like elements throughout, and wherein the various features are not necessarily drawn to scale.

FIG. 1 shows a wireless blasting system with a blasting machine 2 is one a wireless-enabled slave bridge unit 20 located at or near a blast site B that includes a detonator array A with a number of electronic detonators D connected by wires to a single pair of lead lines LL. As shown in FIG. 1, the lead lines LL are connected to a firing circuit 4 of the blasting machine 2, although various operational aspects of the disclosed methods and systems contemplate that the lead lines LL may be connected to the firing circuit 4 only at certain points in a blasting process. A key 3 may be associated with the blasting machine 2 for security purposes, for example, to ensure that the blasting machine 2 operates only once a proper key 3 is installed. In other embodiments, password protection may be provided in the blasting machine 2, requiring an operator to enter a proper password to enable blasting machine operation, and the key 3 may be omitted. The blasting machine 2 further includes a microprocessor and associated electronic memory 6 operatively connected to the firing circuit 4 and to a communications interface 8. As is known, the blasting machine 2 may be housed in a suitable environmental enclosure capable of withstanding the rigors and environmental conditions of blasting sites, and the blasting machine 2 in certain implementations includes an internal battery 10 for operation without requiring connection of external power lines. Other embodiments are possible in which the blasting machine 2 does not include an internal power source, and operates exclusively using power supplied from a connected slave bridge unit 20.

The slave bridge unit 20 is really housed in a suitable enclosure and operated by a battery 30, and may have an associated key 23 for operating the unit 20. The slave bridge unit 20 may alternatively or in combination be password-protected, requiring user entry of a password to enable bridge unit operation, and the key 23 may be omitted. One or both of the blasting machine 2 and the slave bridge unit 20 may also include various user interface features (not shown) allowing an operator to perform various operations by pressing buttons, and may provide a display screen or other output means by which an operator can receive data or messages. The slave bridge unit 20 includes a communications interface 28 allowing communication between the slave bridge unit 20 and the blasting machine 2 connected by a communications cable 12. In addition, the slave bridge unit 20 includes a microprocessor and associated electronic memory 26 that is operatively connected to the communications interface 28 as well as to a wireless transceiver 22 having an associated RF antenna 32. Moreover, the illustrated bridge unit 20 includes a power control circuit 24 operative to selectively enable or disable the firing circuit 4 of the blasting machine 2 by any suitable means, including without limitation provision of firing circuit power 14 and/or by providing a power gating control signal 14, 14*a* in order to control the provision of power to the firing circuit 4, examples of which are further illustrated in FIGS. 2 and 3. Also, the slave bridge unit 20 includes an internal battery 30 allowing field operation.

The processors 6, 26 may be any suitable electronic processing device including without limitation a microprocessor, microcontroller, DSP, programmable logic, etc. and/or combinations thereof, which performs various operations by executing program code such as software, firmware, microcode, etc. The devices 2, 20 each include an electronic memory operatively associated with the corresponding processors 6, 26 to store program code and/or data, including computer executable instructions and data to perform the various functionality associated with blasting machine operation as is known as well as communications tasks and the various function set forth herein. The memory of the devices 2, 20 may be any suitable form of electronic memory, including without limitation RAM, EEPROM, flash, SD, a multimedia card, etc.

As further shown in FIG. 1, a master controller apparatus 40 includes a microprocessor and electronic memory 46 operatively coupled with a user interface 44 and a wireless transceiver 42 with an associated RF antenna 48. In operation, the master controller 40 and the slave bridge unit 20 establish a radio-frequency (RF) or other wireless communications link 34 via the transceivers 42, 22 and the corresponding antennas 48, 32, thus allowing the master controller 40 to 42 operate the slave bridge unit 20 and hence the blasting machine 2 at a significant distance away from the blast site 8, such as several miles in certain implementations. In this manner, the remote positioning of the master controller 40 facilitates operator safety during blasting operations, with the various concepts of the present disclosure further facilitating operator safety as detailed further below.

Figure 2:
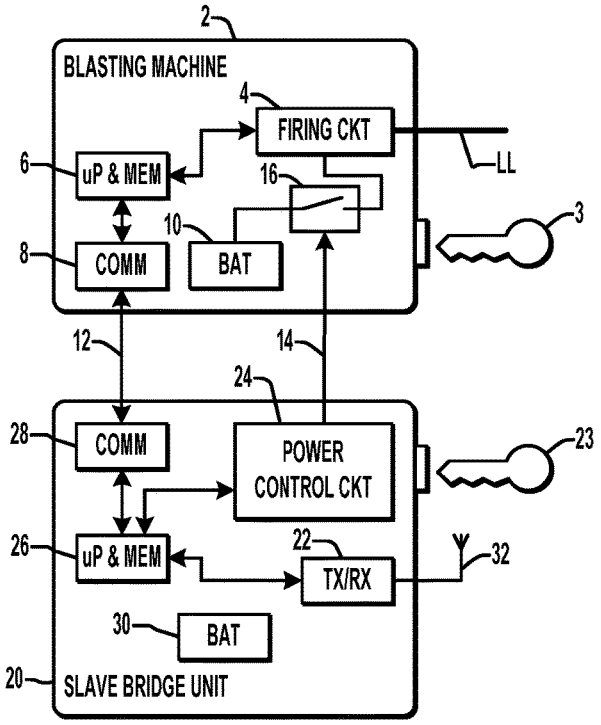
FIGS. 2 and 3 are schematic diagrams illustrating first and second embodiments of the remote turn on and remote turn off features of the blasting machine and slave bridge unit.

Fig. 2 illustrates one possible implementation of the blasting machine 2 and the slave bridge unit 20 facilitating control of the application of electrical power to the blasting machine firing circuit 4 by the slave bridge unit 20. In various situations, the disclosed blasting machine 2 and bridge apparatus 20 advantageously allow remote turn on and/or remote turn off of the firing circuit power, thereby enhancing personal safety for blasting sites. In this implementation, a relay 16 is provided in the blasting machine 2 for selectively connecting power from the blasting machine battery 10 to the firing circuit 4 according to a switching control signal 14 provided by the power control circuit 24 of the slave bridge unit 20. The control signal 14 can be provided from the bridge unit 20 to the blasting machine 2 by a variety of means, including a dedicated control line in a communications cable 12, 14 connecting the units 20 and 2. In another possible embodiment, the power control circuit 24 is implemented in programming of the processor 26, with the processor 26 providing a command message via the communications interfaces 28, 8, with the blasting machine processor 6 controlling operation of the relay 16 accordingly, wherein the switching control signaling 14 is provided via such messaging between the units 20, 2. Other possible implementations may be used by which the slave bridge unit 20 selectively controls the application of power to, or removal of power from, the firing circuit 4 to selectively enable or disable the firing circuit 4 of the blasting machine 2. In this manner, the power control circuit 24 operates under control of the slave bridge unit processor 26 to selectively provide the control signal 14 to either apply power to the blasting machine firing circuit 4 or to ensure that the firing circuit 4 is unpowered.

Figure 3:
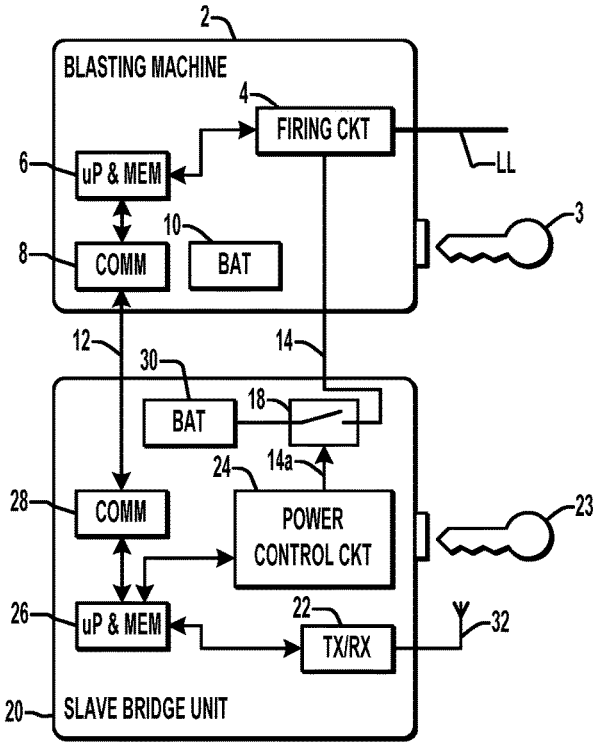

FIG. 3 illustrates another non-limiting embodiment in which a dedicated power line is provided in cabling connecting the blasting machine 2 with the bridge unit 20, including a single wire or pair of wires 14, where a single cable may also include the communications line or lines 12, or separate cabling can be provided. The slave bridge unit 20 in FIG. 3 includes an on-board relay 18 operative to selectively apply power from the bridge unit battery 30 to the firing circuit 4 of the blasting machine 2 according to a switching control signal 14*a* from the power control circuit 24. As in the implementation of FIG. 2, the power control circuit 24 may be a separate circuit operated under control of the bridge unit processor 26, or may be implemented via programming of the processor 26 to selectively provide the switching control signal 14*a* to operate the relay 18 to thereby selectively apply power from the battery 30 to the firing circuit 4, or to ensure that the firing circuit 4 is unpowered according to the state of the switching control signal 14*a*.

In the illustrated implementations, a single contact relay 16, 18 may be used, for example, to connect a positive DC power line to the firing circuit 4, or a relay 16, 18 may be used having multiple contacts, for instance, to selectively connect or disconnect multiple power lines to or from the firing circuit 4. In one possible implementation, the bridge unit processor 26 performs remote turn on of the firing circuit power by asserting the control signal 14 after connection of the bridge unit 20 to the blasting machine 2 only after a verified communications link 34 is established between the master control unit 40 and the slave bridge unit 20. In another possible implementation, the processor 26 of the bridge unit 20 is programmed to enable the firing circuit 4 via the power control circuit 24 and the signaling 14, 14a only upon receipt of a command message from the master controller 40 instructing the bridge unit 20 to apply power to the firing circuit 4. This operation advantageously allows blasting operators to leave the blasting site B before any powered circuit is connected to the detonators D. In addition, the provision of the power control circuitry 24 and selective enabling/disabling of the firing circuit 4 by the slave bridge unit 20 also facilitates remote turn off, whereby the slave bridge unit processor 26 is programmed in certain embodiments to remove power from the firing circuit 4 via the control signaling or messaging 14, 14*a* if the wireless link 34 between the slave bridge unit 20 and the master controller 40 is lost or if the master controller 40 sends a message via the wireless link 34 to the bridge unit 20 with a command to turn off power to the firing circuit 4.

Referring again to FIG. 1, the master controller 40 and the slave bridge unit 20 implement two-way communications via the wireless link 34, by which the master controller 40 remotely controls the operation of the blasting machine 2 with all blasting machine functions and messages being displayed or echoed on the user interface 44 of the master controller 40. In this regard, the blasting machine 2 may have a local user interface (not shown), and may be operable in a local control mode according to a keypad and other means for receiving user inputs locally, with connection to the slave bridge unit 20 placing the blasting machine 2 into a remote control mode for operation according to the master controller 40 via the wireless link 34 and the connection to the slave bridge unit 20. In certain embodiments, echoing of the local blasting machine user interface prompts and displayed information via the bridge unit 20 to the master controller 40 enables the remote operator at the master controller 40 to safely see remotely whatever is on the blasting machine display from a distance. In addition, the system implemented by the interconnection and operation of the master controller 40, the bridge unit 20 and the blasting machine 2 performs various operations using multiple messages with acknowledgment and verification as detailed below in order to further facilitate safe and predictable operation of a remote wireless blasting system.

Figure 4A:
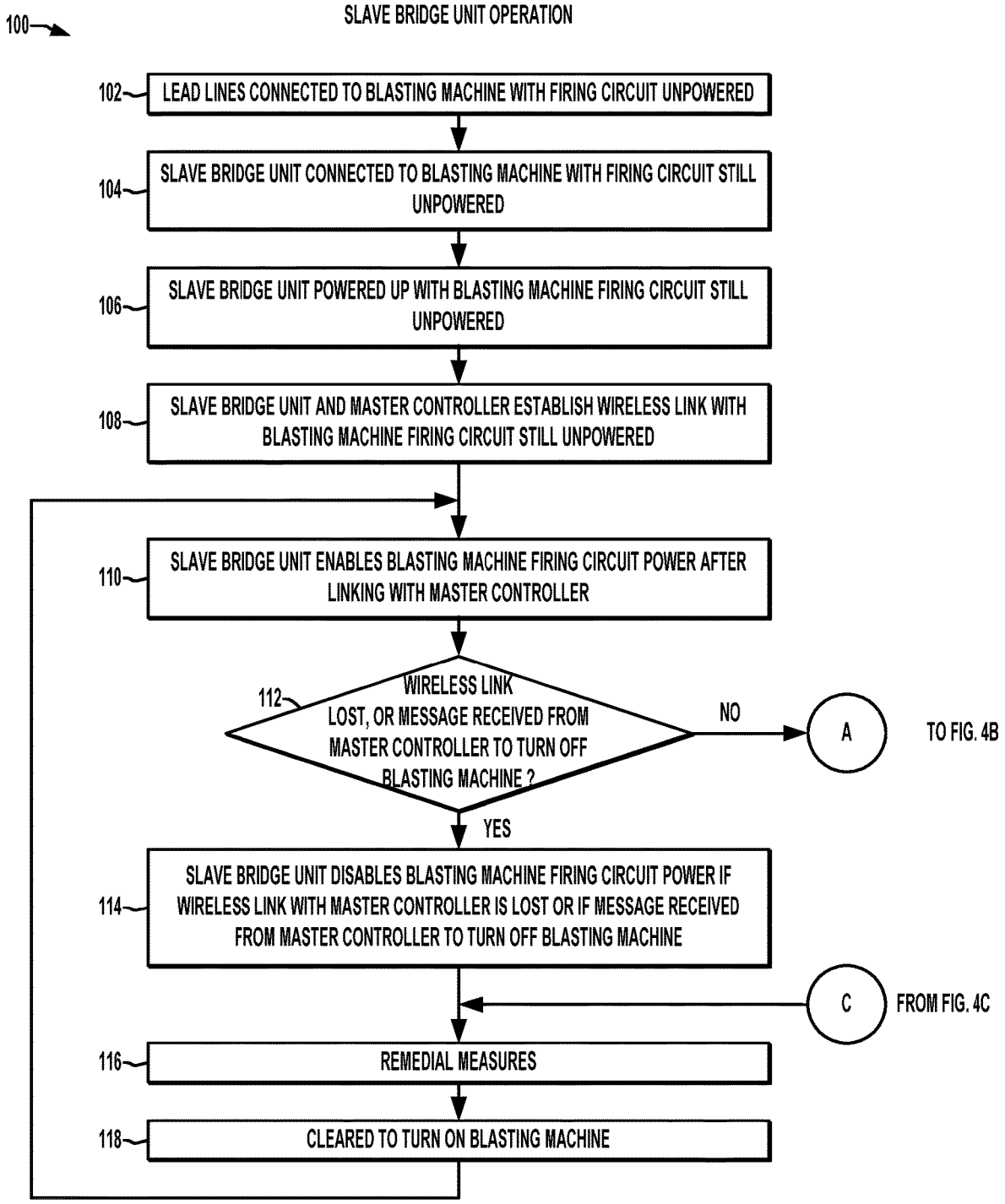
FIGS. 4A-4C provide a flow diagram illustrating an exemplary process for operating the slave bridge unit.
Figure 4B:
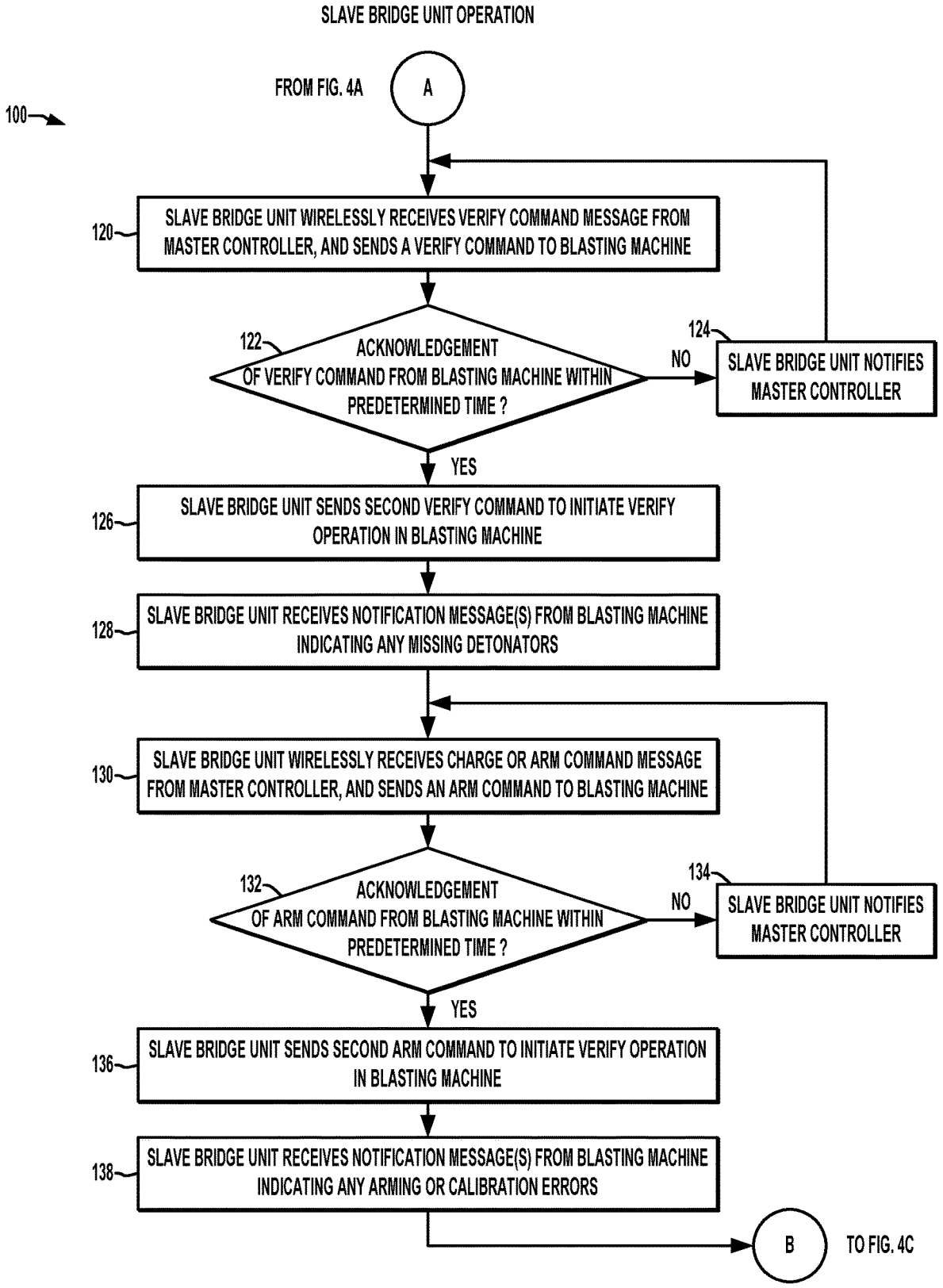
Figure 4C:
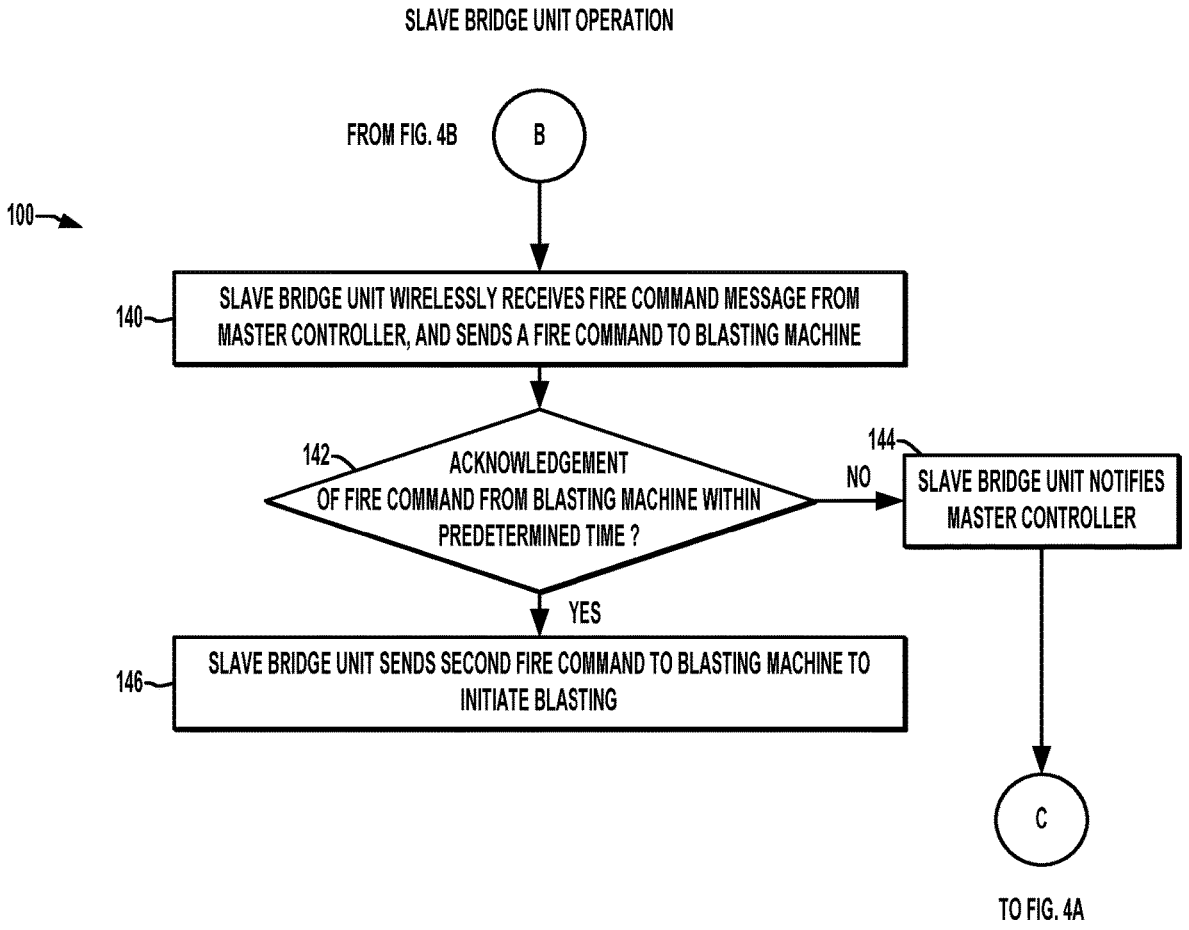
Figure 5:
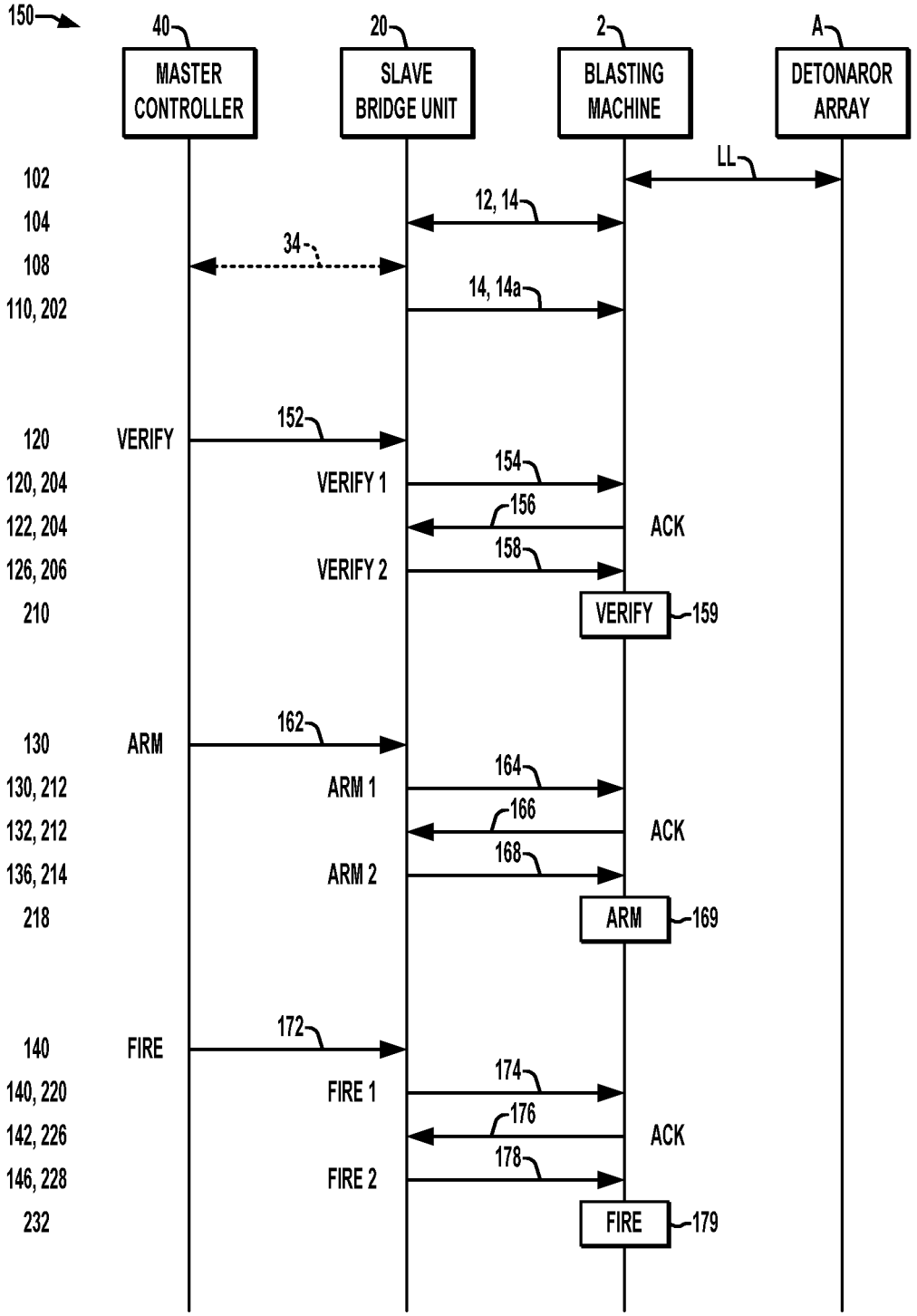
FIG. 5 is a signal flow diagram illustrating operation of the master controller, slave bridge unit and blasting machine in the system of FIG. 1.
Figure 6A:
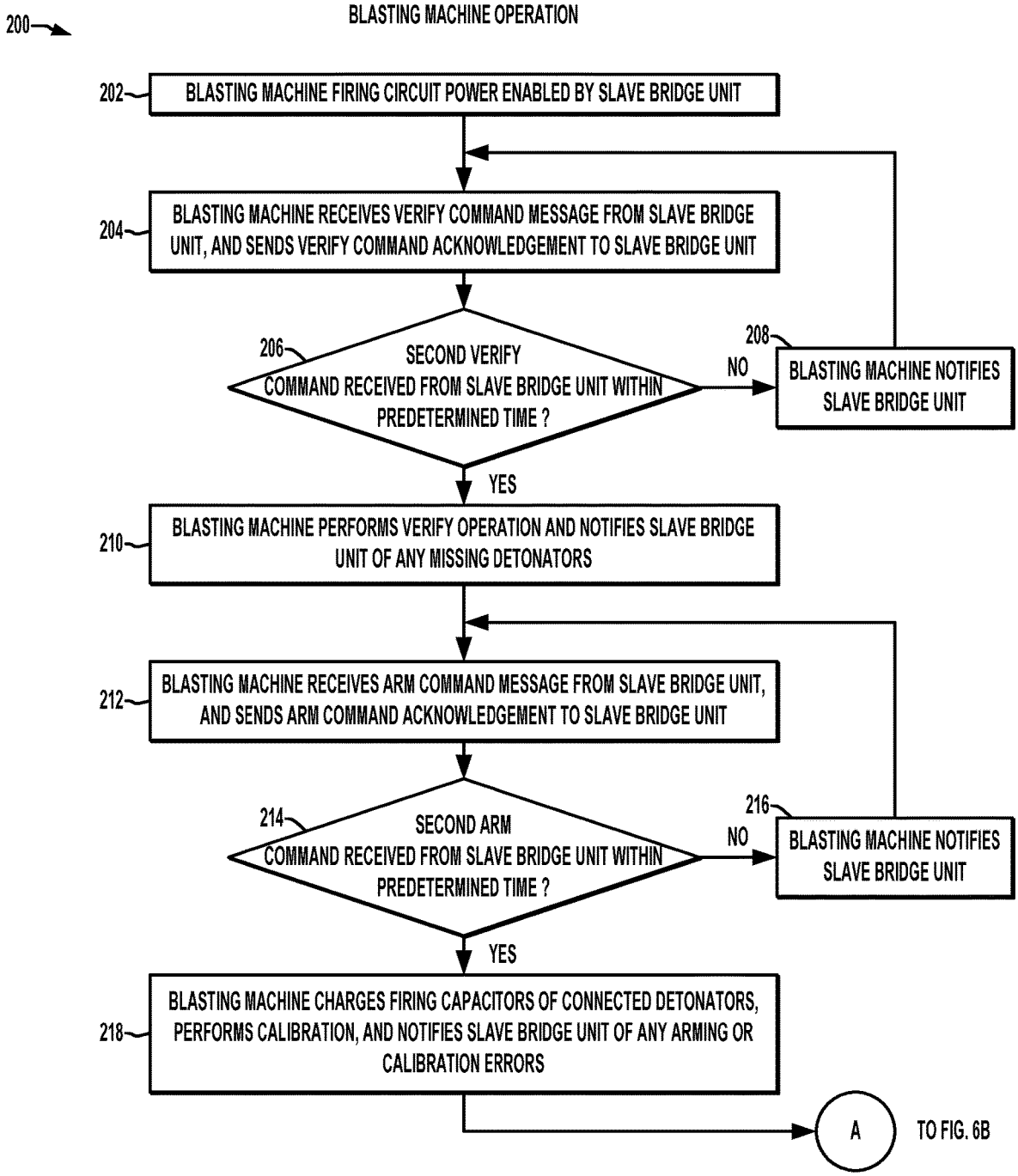
FIGS. 6A-6B provide a flow diagram illustrating an exemplary process for operating the blasting machine.
Figure 6B:
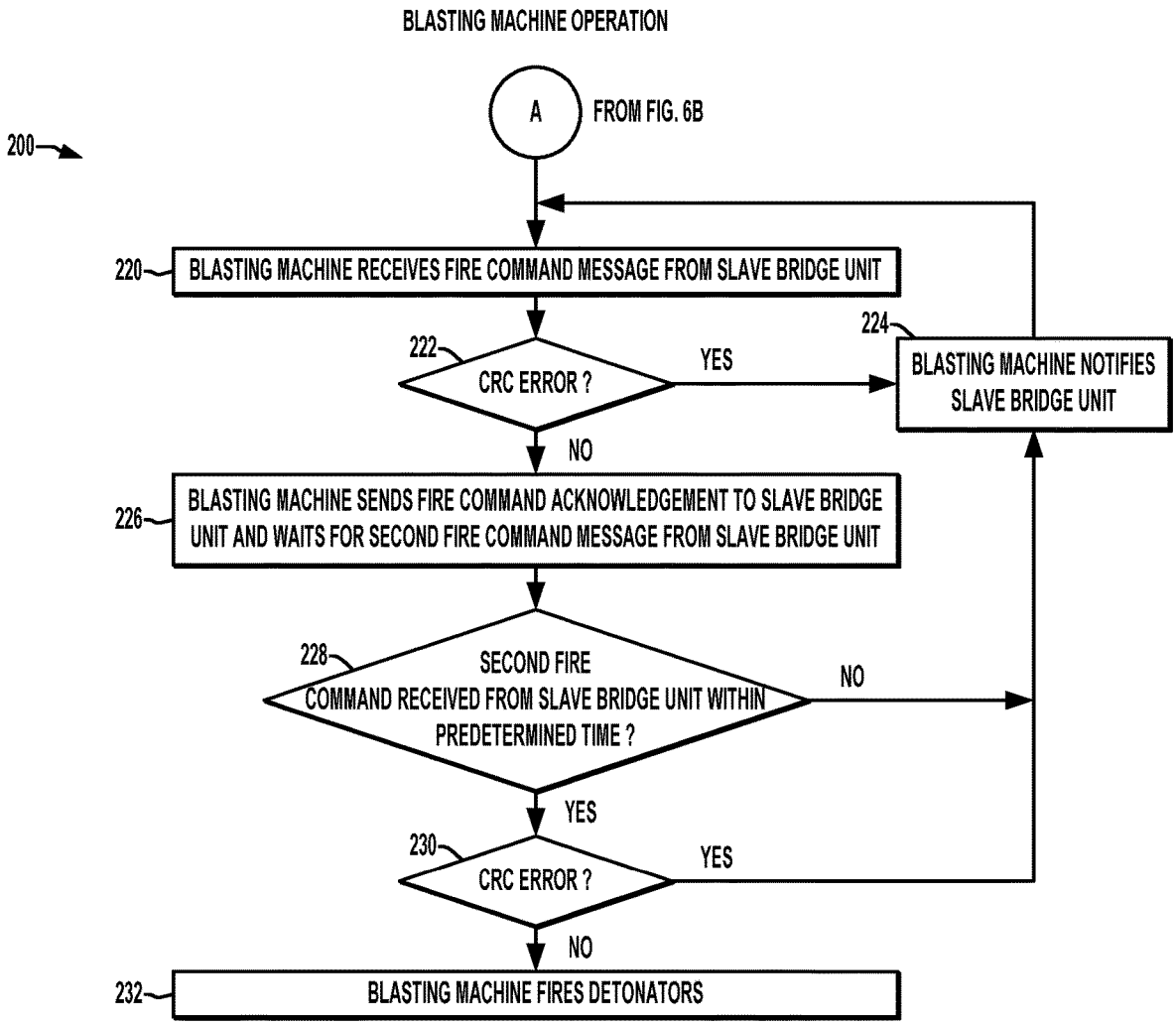

Referring now to FIGS. 4A-6B, exemplary methods 100, 200 are illustrated for implementing a remote wireless blasting operation, including a method 100 in FIGS. 4A-4C showing exemplary operation of the slave bridge unit 20, and a method 200 in FIGS. 6A and 6B for operating the blasting machine 2, along with a signal flow diagram 150 in FIG. 5 showing various interconnections and messaging between the master controller 40, slave bridge unit 20, blasting machine 2 and detonator array A. While the exemplary methods 100 and 200 are illustrated and described hereinafter in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods 100, 200 and other methods of the disclosure may be implemented in hardware, processor-executed software, or combinations thereof, such as in the exemplary blasting machine 2 and slave bridge unit 20 described herein, and may be embodied in the form of computer executable instructions stored in a non-transitory computer readable medium such as the memories associated with the processors 6 and 26.

In one possible remote wireless blasting procedure, electronic detonators D are programmed and logged using one or more loggers (not shown), with detonator delay times being programmed during the logging process, or such delay times may have been previously programmed. Thereafter, the detonators D are connected to each of their individual branch wires, and a logger may be used to verify that each detonator D in a specific branch is properly electrically connected. Detonator data may then be transferred from the logger to the blasting machine 2, such as by electrical connection of the longer (not shown) to the communications interface 8 for transfer of the detonator data. Branch wires may then be connected to the lead line wiring LL, where the lead line wiring LL may extend some difference from the detonator array A to the position of the blasting machine 2.

The process 100 begins at 102 in FIG. 4A begins in one example with connection of the lead lines LL from the detonator array A to the blasting machine 2 while the blasting machine 2 and the firing circuit 4 thereof remain unpowered. On-site blasting personnel may then insert and turn the power keys 3 and 23 of the blasting machine 2 and the slave bridge unit 20, but the firing circuit 4 of the blasting machine 2 initially remains off. The slave bridge unit 20 is connected to the blasting machine 2 at 104, with the bridge unit 20 maintaining the unpowered condition of the blasting machine firing circuit 4. At 106 in FIG. 4A, the slave bridge unit 20 is powered up while still maintaining the blasting machine firing circuit 4 in the unpowered state. The blasting site B may then be cleared of personnel and/or extra equipment.

At 108, the bridge unit 20 and the master controller 40 establish a wireless communications link 34 with the blasting machine firing circuit 4 still unpowered under control of the power control circuit 24 implemented in the slave bridge unit 20. At 110 in FIG. 4A, the slave bridge unit enables the blasting machine firing circuit power after linking with the master controller 40. This is schematically illustrated in the signal flow diagram 150 of FIG. 5, in which the slave bridge unit 20 provides suitable signaling and/or messaging 14, 14A to the blasting machine 2 under control of the slave bridge unit processor 26 to initiate application of electrical power to the firing circuit 4, for example, using the relay circuit control techniques shown in FIG. 2 or 3 above. In one possible embodiment, the bridge unit 20 sends a command message "BM0" or "BM1" to the blasting machine 2, which may be acknowledged by the blasting machine 2 in certain implementations. The slave bridge unit processor 26 determines at 112 in FIG. 4A whether the wireless link 34 has been lost, or alternatively whether a message has been received from the master controller 40 including a command or instruction to turn off the blasting machine 2. If so (YES at 112), the method 100 continues to 114 where the slave bridge unit 20 disables the blasting machine firing circuit power via the power control circuit 24 and any associated signaling or messaging 14, 14*a*, and one or more remedial measures may be undertaken at 116. For instance, if the wireless link 34 was lost, blasting personnel may safely visit the blasting site B, if necessary, to service the slave bridge unit 20 or take other actions to reestablish the communications link 34. Alternatively, if the remote turn off feature was initiated by receipt of a message from the master controller 40, the blasting personnel can attend to other situations at the blast site B with the assurance that the firing circuit 4 of the blasting machine 2 has been disabled. Once the remedial measures have been undertaken at 116, blasting personnel can determine that it is now safe to again turn on the blasting machine at 118, with the process 100 returning to 110 for the slave bridge unit 20 to enable the blasting machine firing circuit power after again establishing the communications link with the master controller 40, and optionally after receiving a specific command from the master controller 40 to again power up the blasting machine firing circuit 4.

Once it is determined at 112 that the wireless link 34 is operational and no turn off messaging has been received from the master controller 40 (NO at 112 in FIG. 4A), the process 100 proceeds to 120 in FIG. 4B with the slave bridge unit 20 wirelessly receiving a verify command message from the master controller 40 (shown as a wireless verify command message 152 in FIG. 5) and sending a verify command message to the blasting machine 2 (message 154 in FIG. 5). In one possible embodiment, the blasting machine 2 receives the verify command 154 and performs one or more verification operations, while the operator at the master controller 40 may monitor the user interface 44 to verify proper interconnection of the various detonators D. In the illustrated implementation, moreover, the slave bridge unit 20 and the blasting machine 2 further ensure proper receipt of a verify command with the blasting machine 2 using two or more verify commands from the bridge unit 20 an acknowledgment by the blasting machine 2 as shown. In this case, the bridge unit 20 waits for an acknowledgment message from the blasting machine 2 at 122 in FIG. 4B. If no acknowledgment is received (NO at 122), the slave bridge unit 20 notifies the master controller 40 at 124, and the process 100 returns to await another verify command from the master controller 40 at 120. If the blasting machine 2 provides an acknowledgment (message 156 in FIG. 5) within a predetermined time (YES at 122 in FIG. 4B), the slave bridge unit 20 sends a second verify command (message 158 in FIG. 5) to the blasting machine 2 at 126 in FIG. 4B. The verify process, in this regard, may be individualized for specific detonators D, and the multiple command messaging with acknowledgment shown at 120-126 in FIG. 4B may be implemented at the beginning of a verification process, with further single messaging being used to verify individual detonators D. The slave bridge unit 20, moreover, may receive one or more notification messages at 128 in FIG. 4B from the blasting machine 2 indicating any missing detonators or other verify process status indicators, which can then be relayed via the wireless link 34 to the remote master controller 40 for display to an operator via the user interface 44.

At 130 in FIG. 4B, the slave bridge unit 20 wirelessly receives a charge or "ARM" command message (message 162 in FIG. 5) from the master controller 40, and sends an arm command to the blasting machine 2 (message 164 in FIG. 5). In certain embodiments, the blasting machine 2 responds to the first arm command and charges firing capacitors of connected detonators D, and may perform calibration processing as well, and reports any arming or calibration errors to the slave bridge unit 20, which are then forwarded to the master controller 40 for display to an operator via the user interface 44. In the illustrated implementation, the bridge unit 20 waits for an acknowledgment at 132 in FIG. 4B of the arm command from the blasting machine 2, and if no such acknowledgment is received within a predetermined time (NO at 132), notifies the master controller 40 and returns to 132 await receipt of another charge or arm command from the master controller 40. Otherwise (YES at 132), once the acknowledgment from the blasting machine 2 has been received within the predetermined time (acknowledgment message 166 in FIG. 5), the slave bridge unit 20 sends a second arm command (message 168 in FIG. 5) to the blasting machine 2 at 136 in FIG. 4B, and receives one or more notification messages at 138 from the blasting machine 2 indicating any arming our calibration errors, which are then forwarded via the wireless link 34 to the master controller 40.

Continuing in FIG. 4C, the slave bridge unit 20 wirelessly receives a fire command at 140 from the master controller 40 (message 172 in FIG. 5), and sends a fire command to the blasting machine 2 (command message 174 in FIG. 5). At 142, the bridge unit 20 waits for an acknowledgment of the fire command from the blasting machine 2, and if no acknowledgment is received within a predetermined time (NO at 142) the bridge unit 20 notifies the master controller 40 at 144, and the process returns for remedial measures at 116 in FIG. 4A. If the slave bridge unit 20 receives a proper acknowledgment of the fire command (YES at 142 in FIG. 4C, acknowledgment message 176 in FIG. 5), the slave bridge unit 20 sends a second fire command (message 178 in FIG. 5) at 146 to complete the blasting process 100. As seen in FIG. 5, moreover, this causes the blasting machine 2 in certain embodiments to fire the detonator array A at 179. In other embodiments, the slave bridge unit 20 need not implement a timeout function, and may instead continue to await receipt of a second or subsequent fire command at 142 in FIG. 4C. In certain embodiments, moreover, the blasting machine 2 may be configured to implement a predetermined timeout for receipt of the second command message 178, and if not received from the slave bridge unit 20 in the predetermined period of time, may issue a message to the slave bridge unit 20 indicating that the fire process, if intended, needs to be restarted. In addition, although illustrated and described above in the context of a dual message process with intervening acknowledgment, more than 2 fire command messages may be required, with intervening acknowledgments from the blasting machine 2, in order to fire the detonators D at 179 in FIG. 5.

In this manner, if the initial fire command message 174 was not properly received by the blasting machine 2, or if the communications interface 12 between the blasting machine 2 in the slave bridge unit 20 is inoperative or intermittent, the bridge unit 20 will not send a second or subsequent fire command to the blasting machine 2. Moreover, as discussed further below in connection with FIGS. 6A and 6B, the blasting machine 2 is adapted to await a second or subsequent fire command before actually firing the detonators D via the firing circuit 4. Consequently, the wireless blasting system of the present disclosure advantageously employs multiple fire command messaging between the blasting machine 2 and the slave bridge unit 20 in order to ensure that the blasting machine 2 only acts upon intended firing commands. In this regard, should the blasting machine 2 inadvertently receive a different command or spurious noise via of the communications interface 8 which is interpreted as being a single fire command, without the slave bridge unit 20 actually intending to cause the detonators D to be fired, no unintended firing will be initiated by the blasting machine 2. Consequently, this aspect of the present disclosure facilitates safe controlled detonation of the detonator array A and presents a significant robust system architecture providing an advance over conventional wireless blasting systems which could be susceptible to misinterpretation of single firing command messages or signals.

Referring also to FIGS. 6A and 6B, the process 200 illustrates exemplary operation of the blasting machine 2 in conjunction with the above-described bridge unit operation in FIGS. 4A-4C and 5. At 202 in FIG. 6A, the blasting machine firing circuit power is enabled by the slave bridge unit (signaling 14, 14*a* in FIG. 5). At 204, the blasting machine 2 receives a verify command message (message 154 in FIG. 5) and sends a verify command acknowledgment in certain embodiments to the slave bridge unit 20 (acknowledgment 156 in FIG. 5). As mentioned previously, certain embodiments of the blasting machine 2 and slave bridge unit 20 may provide for single messaging for verify operation, with or without acknowledgment. In the illustrated example, the blasting machine 2 waits at 206 in FIG. 6A for a second verify command to be received from the slave bridge unit 20, and if no second or subsequent verify command is received (NO at 206), the blasting machine 2 notifies the slave bridge unit 20 at 208, and returns to 204 as described above. If the second verify command (message 158 in FIG. 5) is received within a predetermined time (YES at 206), the blasting machine 2 performs one or more verification operations at 210 and may notify the slave bridge unit 20 of any missing (unverified) detonators D. In certain embodiments, moreover, the blasting machine 2 performs a remote out of sync prevention process 400 as further described below in connection with FIG. 8 to selectively perform the verification operation or operations at 210 after verifying synchronization with the master controller 40.

At 212 in FIG. 6A, the blasting machine 2 receives an arm command message (message 164 in FIG. 5) from the slave bridge unit 20, and sends an arm command acknowledgment (message 166 in FIG. 5) to the slave bridge unit 20. In certain embodiments, the blasting machine 2 may be programmed to initiate detonator arming in response to the first arm command message 164, with or without sending any acknowledgment message 176. In the illustrated implementation, moreover, the blasting machine 2 waits at 214 in FIG. 6A for receipt of a second arm command from the slave bridge unit 20 (arm command 168 in FIG. 5), and may implement a timeout period in certain embodiments. If a second arm command is not received within the optional predetermined time period (NO at 214), the blasting machine 2 notifies the slave bridge unit at 216 and returns to await a first verify command message at 212 as described above. Otherwise (YES at 214), the machine 2 charges the firing capacitors of the connected detonators D and performs calibration at 218, and may notify the slave bridge unit 20 of any arming or calibration errors. As discussed further below in connection with FIG. 8, certain embodiments of the blasting machine 2 implement a remote out of sync operation before charging the firing capacitors and performing other operations at 218.

The process 200 then continues at 220 in FIG. 6B, where the blasting machine 2 receives a fire command message (message 174 in FIG. 5) from the bridge unit 20, and performs a cyclical redundancy check (CRC) evaluation at 222 to determine whether the received fire command message 174 is correct. If there is a CRC error (YES at 222), the blasting machine 2 notifies the slave bridge unit 20 at 224 that an erroneous message has been received, and returns to await retransmission of any valid fire command message at 220. If there was no CRC error in the first fire command message (NO at 222), the blasting machine sends a fire command acknowledgment (message 176 and FIG. 5) to the slave bridge unit 20, and waits for receipt of a second or subsequent fire command message from the bridge unit 20 at 226. If a second or subsequent fire command message (e.g., second fire command message 178 in FIG. 5) is received at 228 from the slave bridge unit 20 (YES at 228), a CRC error check is performed at 230 by the blasting machine 2. If no CRC error occurs in the second received fire command message (NO at 230), the blasting machine fires the detonators D at 232 to complete the blasting process. In certain embodiments, moreover, even if the second fire command message is properly received without CRC errors, the blasting machine 2 verifies synchronization with the remote master controller 40 via a process 400 in FIG. 8 before firing the detonators at 232, as described further below.

The firing of the detonators at 232 can be by any suitable operation of the blasting machine using the firing circuit 4. For example, where electronic detonators D are used, the blasting machine 2 may issue a fire command at 232 in FIG. 6B along the lead lines LL to cause the detonators D to fire according to any programmed delay times in the detonators D (also shown at 179 in FIG. 5). As previously discussed, moreover, although the operation in FIG. 6B illustrates usage of first and second fire commands 174 and 178 with an intervening acknowledgment message 176 by the blasting machine 2, other implementations are possible in which more than two fire command messages must be received before the blasting machine 2 will fire the detonators at 232. Further, while the blasting machine 2 implements a timeout period in the determination at 228 in FIG. 6B, other implementations are possible in which no timeout period is used, and the blasting machine 2 will fire the detonators D in response to receipt of the second (or subsequent) fire command message 178. In cases where a CRC error occurs at 222 or 230, moreover, the blasting machine 2 will notify the slave bridge unit 20 at 224, and will itself treat the received fire command message(s) as invalid or as an automatic abort command, and thus the blasting machine 2 will not cause the detonators D to be fired.

Figure 7:
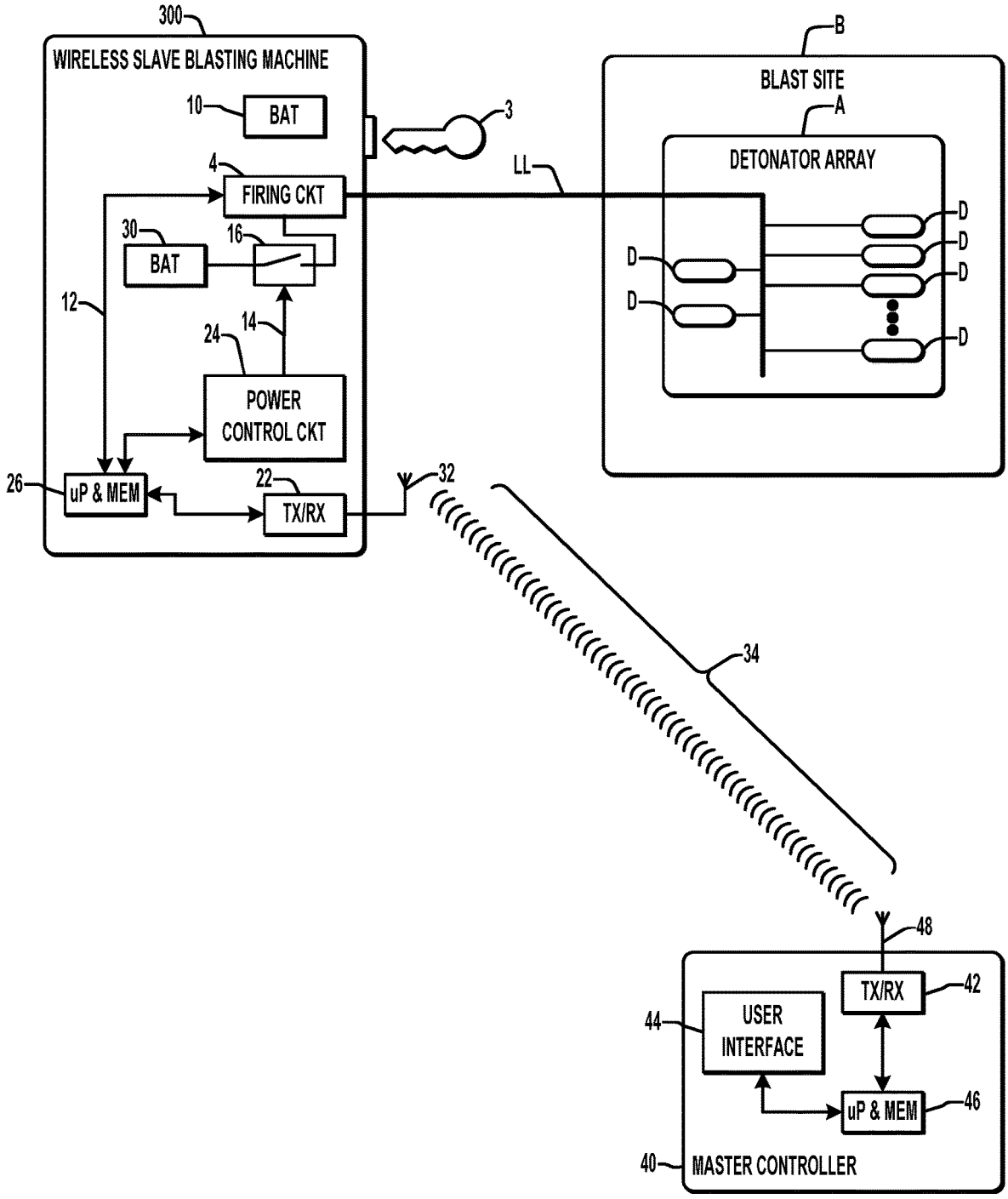
FIG. 7 is a simplified system diagram illustrating an alternate wireless blasting system with a wireless slave blasting machine in accordance with further aspects of the present disclosure.

FIG. 7 illustrates another wireless blasting system with a wireless slave blasting machine 300 according to further aspects of the present disclosure. In this case, the blasting machine 300 is equipped with a wireless transceiver 22 and associated wireless antenna 32 for wireless (e.g., RF) communications 34 with the master controller 40. In addition, the wireless slave blasting machine 300 in this example includes a firing circuit 4 for connection to the lead lines LL of the detonator array A, and may be selectively operable by way of a key 3, and/or the unit 300 may be password-protected in certain implementations. The wireless slave blasting machine 300 in general implements the functions and features of the slave bridge unit 20 and the blasting machine 2 of FIG. 1, and includes a power control circuit 24 operative to selectively enable or disable provision of power to a firing circuit 4 connected to one or more detonators D as shown, for example, using a power control circuit 24 and a relay 16 as described above. In addition, the blasting machine 300 includes one or more batteries 30 to power various internal circuitry and the firing circuit 4 by way of a power control relay 16 as described above.

The processor 26 of the wireless slave blasting machine 300 in certain embodiments is programmed to receive a first wireless fire command message (e.g., like command 172 above) from the master controller 40 via the wireless transceiver 22 using the wireless connection 34, as well as to receive a second wireless fire command message from the master controller 40, and to selectively fire one or more connected detonators D via the firing circuit 4 only after receiving both the first and second fire command message from the master controller 40 via the wireless transceiver 22. In certain embodiments, the wireless blasting machine 300 will only fire the detonators D if the first and second fire command messages are received from the master controller 40 within a predetermined time period. In certain embodiments, moreover, the wireless blasting machine 300 will send a fire command acknowledgment message to the master controller 40 via the wireless transceiver 22 in response to receiving the first fire command message 172. Moreover, the wireless slave blasting machine 300 in certain embodiments implements remote turn on/off, with the processor 26 being programmed to selectively enable or disable the firing circuit 4 (e.g., via the power control circuit 24 providing a relay control signal 14 to the relay 16 in FIG. 7) in response to wirelessly receiving a remote turn on or remote turn off command from the master controller 40.

In certain related aspects, the master controller 40, and the processor 46 thereof, may be programmed to receive an input from an operator (e.g., via the user interface 44) for initiation of a firing operation, and to automatically wirelessly transmit first and second firing command messages via the wireless link 34 to the wireless slave blasting machine 300 of FIG. 7. In one implementation, the master controller 40 sends the second firing command message within a predetermined time following transmission of the first firing command message. In certain implementations, moreover, the master controller 40 will selectively transmit the second firing command message only in response to receipt of a firing command acknowledgment message received through the wireless link 34 from the wireless slave blasting machine 300.

In accordance with further aspects of the disclosure, the slave bridge unit 20 and blasting machine 2 (e.g., FIG. 1) and/or the wireless slave blasting machine (FIG. 7) implement remote turn on/turnoff operation according to commands from the master controller 40, independent of specific fire command operation of these devices. In this manner, the operator at the master controller 40 may selectively disable the firing circuit 4 through transmission of a disable message from the master controller 40 to either a wireless slave blasting machine 300 as set forth in FIG. 7 or to a wireless slave bridge unit 20 as seen in FIG. 1. Also, the operator may use the master controller 40 to wirelessly send an enable command or message via the wireless link 34 to either the wireless slave blasting machine 300 or to a slave bridge unit 20 in order to remotely enable (e.g., power) the corresponding firing circuit 4.

Figure 8:
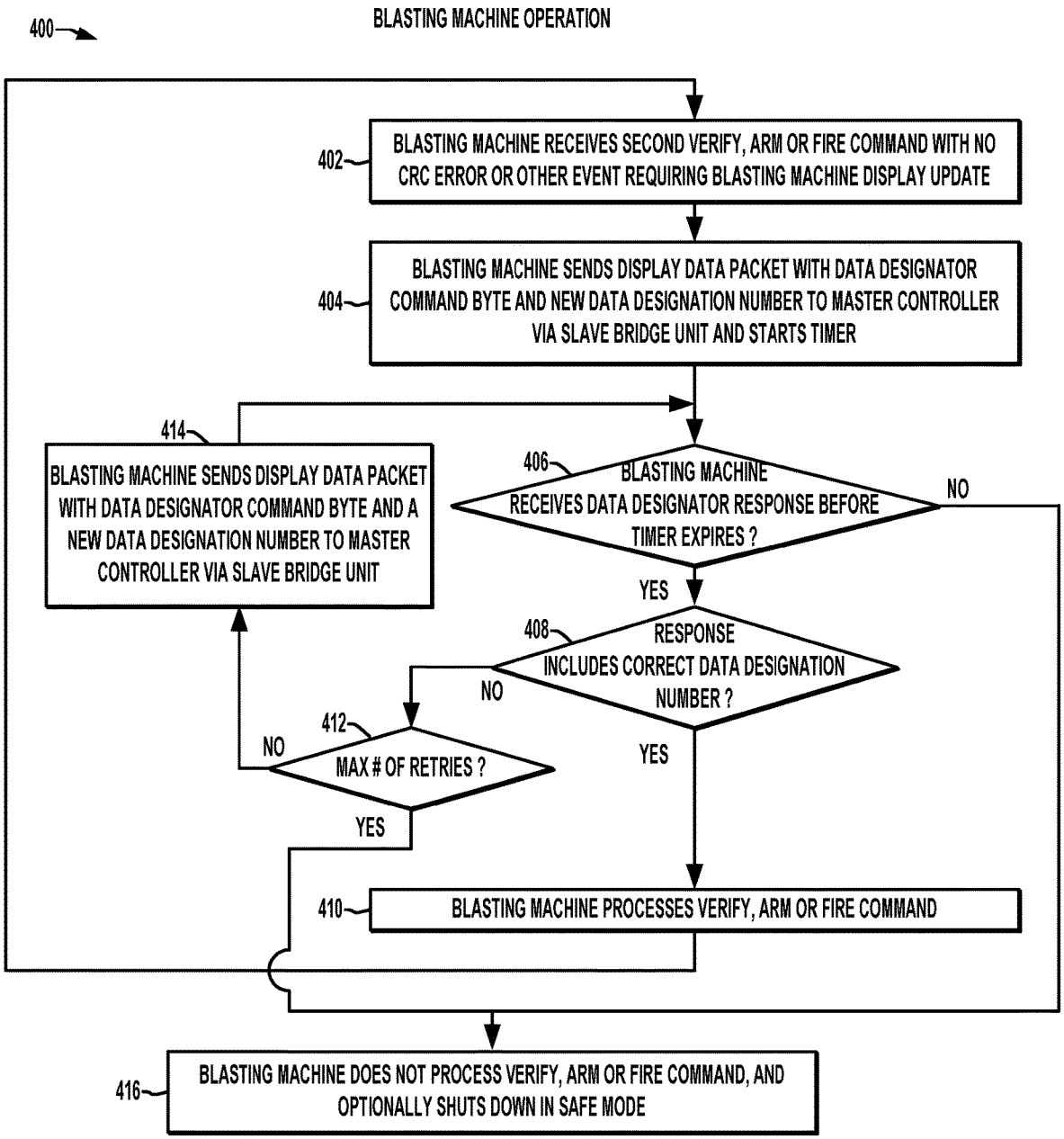
FIG. 8 is a flow diagram illustrating a data designation process to prevent remote out-of-sync conditions between the blasting machine and the remote master controller.

In accordance with further aspects of the present disclosure, the multiple fire command message concepts (and/or multiple verify and multiple arm message concepts), alone or in further combination with the associated predetermined times and/or acknowledgment message concepts, may be implemented in association with multiple slave bridge units 20 and/or multiple wireless enabled slave blasting machines 300 or combinations thereof. In this manner, a single master controller 40 can wirelessly control multiple bridge units 20 and/or multiple wireless blasting machines 300 with respect to detonator firing operations and other associated tasks such as verification and/or arming. Moreover, the remote turn on/turnoff features of the illustrated and described master controller 40, wireless slave blasting machine 300 and slave bridge units 20 can be implemented in systems having a single master controller 40 operatively coupled via corresponding wireless links 34 to multiple slave blasting machines 300, or multiple slave bridge units 20, or combinations thereof, by which the master controller 40 may selectively enable or disable multiple firing circuits 4. Referring now to FIG. 8, certain embodiments of the blasting machine 2, 300, any included slave bridge unit 20, and the master controller 40 are configured to implement a data designation process 400 to prevent one or more operations if remote out-of-sync conditions are detected between the blasting machine 2, 300 and the remote master controller 40. In particular, when the blasting machine 2, 300 receives a second verify, arm or fire command (e.g., at 206 or 214 in FIG. 6A or at 228, 230 in FIG. 6B) or any other event occurs at 402 in FIG. 8 for which the blasting machine 2, 300 updates its display, the blasting machine 2, 300 sends a wireless display data packet or other message to the master controller 40 at 404, either directly as per the blasting machine 300 in FIG. 7, or indirectly through an associated slave bridge unit 20 as shown in FIG. 1 above. This first out of sync prevention message at 404 includes the updated display data for updating the remote master controller 40, as well as a data designator command, such as a command bite, and a data designation number determined by the blasting machine 2, 300. In addition, the blasting machine 2, 300 starts a timer at 404 to establish a predetermined time following transmission of the first message.

If the blasting machine 2, 300 and the master controller 40 are synchronized properly with a functioning direct or indirect wireless communications link established, the master controller 40 receives the first message and processes the display data to update its own display, and sends a wireless "Data Designator" response message back to the blasting machine 2, 300 directly or through any associated slave bridge unit 20. The response message includes the data designation number originally transmitted from the blasting machine 2, 300 at 404 in FIG. 8. At 406, the blasting machine 2, 300 determines whether the data designator response message was received before expiration of the timer started at 404. If so (YES at 406), the blasting machine 2, 300 determines at 408 whether the response message includes the correct data designation number provided with the display data packet at 404. If so (YES at 408), the blasting machine 2, 300 processes the received verify, arm or fire command (e.g., at 210 or 218 in FIG. 6A, or at 232 in FIG. 6B above). Thereafter, the process 400 returns to 402 as described above. If the blasting machine 2, 300 does not receive any data designator response before the timer expires (NO at 406), the blasting machine at 416 refrains from processing the requested verify, arm or fire command, and may optionally shut down in a safe mode.

If, however, the blasting machine 2, 300 receives a data designator response before expiration of the timer (YES at 406) but the response does not include the correct data designation number (NO at 408), the blasting machine 2, 300 determines at 412 whether a predetermined maximum number of retransmissions of the display data packet has occurred. If not (NO at 412), the blasting machine 2, 300 sends another display data packet with the data designator command bite and a new data designation number at 414 to the master controller 40 (e.g., via a slave bridge unit 20 or directly), and returns to 406 to await a response from the master controller 40. If the blasting machine 2, 300 receives a response to the second message including the new data designator number (YES at 408), the requested verify, arm or fire command is processed at 410. In addition, this retransmission attempt processing at 406, 408, 412 and 414 can repeat until the predetermined maximum number of retries has occurred (YES at 412) or until the timer expires without receipt of a data designator response message including the most recent data designation number (NO at 416), in which case the blasting machine 2, 300 refrain from processing the verify, arm or fire command at 416, and may optionally shut down in the safe mode. In this manner, the master controller 40 and the blasting machine 2, 300 are ensured to be synchronized before performance of critical operations by the blasting machine 2, 300, and the display data presented to an operator at the remote master controller 40 correctly reflects the display data at the blasting machine 2, 300.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. A method for wireless detonator blasting, comprising:

using a wireless enabled bridge unit coupled with a blasting machine via a communications cable, wirelessly receiving a wireless fire command message from a master controller;

using the wireless enabled bridge unit, sending a first fire command message to the blasting machine via the communications cable;

using the wireless enabled bridge unit, sending a second fire command message to the blasting machine via the communications cable within a predetermined time after sending the first fire command message to the blasting machine; and using the blasting machine, selectively firing at least one connected detonator only if both the first and second fire command messages are received from the wireless enabled bridge unit within the predetermined time.

2. The method of claim 1, further comprising:

using the wireless enabled bridge unit, selectively enabling or disabling a firing circuit of the blasting machine in response to wirelessly receiving a remote turn on or remote turn off command from a master controller.

3. The method of claim 1, further comprising:

using the wireless enabled bridge unit, selectively enabling or disabling a firing circuit of the blasting machine in response to wirelessly receiving a remote turn on or remote turn off command from a master controller.

4. A method for wireless detonator blasting, comprising:

using a wireless blasting machine having a wireless transceiver operative to communicate with a remote master controller and a firing circuit operative when enabled and powered to fire at least one connected detonator, wirelessly receiving a wireless first fire command message from a master controller;

using the wireless blasting machine, wirelessly receiving a wireless second fire command message from the master controller; and using the wireless blasting machine, selectively firing the at least one connected detonator only if both the first and second fire command message are received from the master controller within a predetermined time.

5. A method for wireless detonator blasting, comprising:

using a blasting machine having a direct or indirect wireless communications link with a remote master controller and a firing circuit operative when enabled and powered to fire at least one connected detonator, directly or indirectly receiving a wireless verify, arm or fire command message from the remote master controller;

using the blasting machine directly or indirectly sending a wireless first message to the remote master controller in response to receiving the wireless verify, arm or fire command message, the first message including display data, a data designator command, and a data designation number;

using the blasting machine:

selectively processing the verify, arm or fire command message if the blasting machine directly or indirectly receives, from the remote master controller, a wireless data designator response message including the data designation number sent in the first message within a predetermined time after sending the wireless first message, and selectively refraining from processing the verify, arm or fire command message if the blasting machine does not directly or indirectly receive, from the remote master controller, a wireless data designator response message including the data designation number sent in the first message within the predetermined time after sending the wireless first message.

6. The method of claim 5, comprising:

in response to receiving a wireless data designator response message that does not include the data designation number sent in the first message within the predetermined time after sending the wireless first message, using the blasting machine, directly or indirectly sending a wireless second message to the remote master controller, the second message including the display data, a data designator command, and a different second data designation number;

selectively processing the verify, arm or fire command message if the blasting machine directly or indirectly receives, from the remote master controller, a second wireless data designator response message including the second data designation number sent in the second message within the predetermined time after sending the wireless first message, and selectively refraining from processing the verify, arm or fire command message if the blasting machine does not directly or indirectly receive, from the remote master controller, a wireless data designator response message including the first or second data designations within the predetermined time after sending the wireless first message. age.

* * * * *